United States Patent [19]

Atmore et al.

[11] 4,030,989

[45] June 21, 1977

[54] ELECTROWINNING PROCESS

[75] Inventors: Milton Graham Montgomery Atmore; Roy Duncan Macpherson, both of Johannesburg, South Africa

[73] Assignee: Anglonor S. A., Luxembourg, Luxembourg

[22] Filed: May 11, 1976

[21] Appl. No.: 685,148

[52] U.S. Cl. ..... 204/104; 204/108; 204/112; 204/119

[51] Int. Cl.[2] ..... C25B 1/22; C25C 1/08; C25C 1/12; C25C 1/11

[58] Field of Search ..... 204/104, 108, 112, 119

[56] References Cited

UNITED STATES PATENTS 2,810,686 10/1957 Bodamer et al. ..... 204/112

FOREIGN PATENTS OR APPLICATIONS 21,193 3/1893 United Kingdom ..... 204/119

*Primary Examiner*—R. L. Andrews
*Attorney, Agent, or Firm*—Armstrong, Nikaido & Marmelstein

[57] ABSTRACT

Metals from sulfate leach solutions derived from sulfide ores are electrowon in a cell divided by a permionic membrane whereby metal pregnant solution is fed to the cathode compartment and sulfuric acid is generated in the anode compartment.

17 Claims, 2 Drawing Figures

ELECTROWINNING PROCESS

Figure 1:
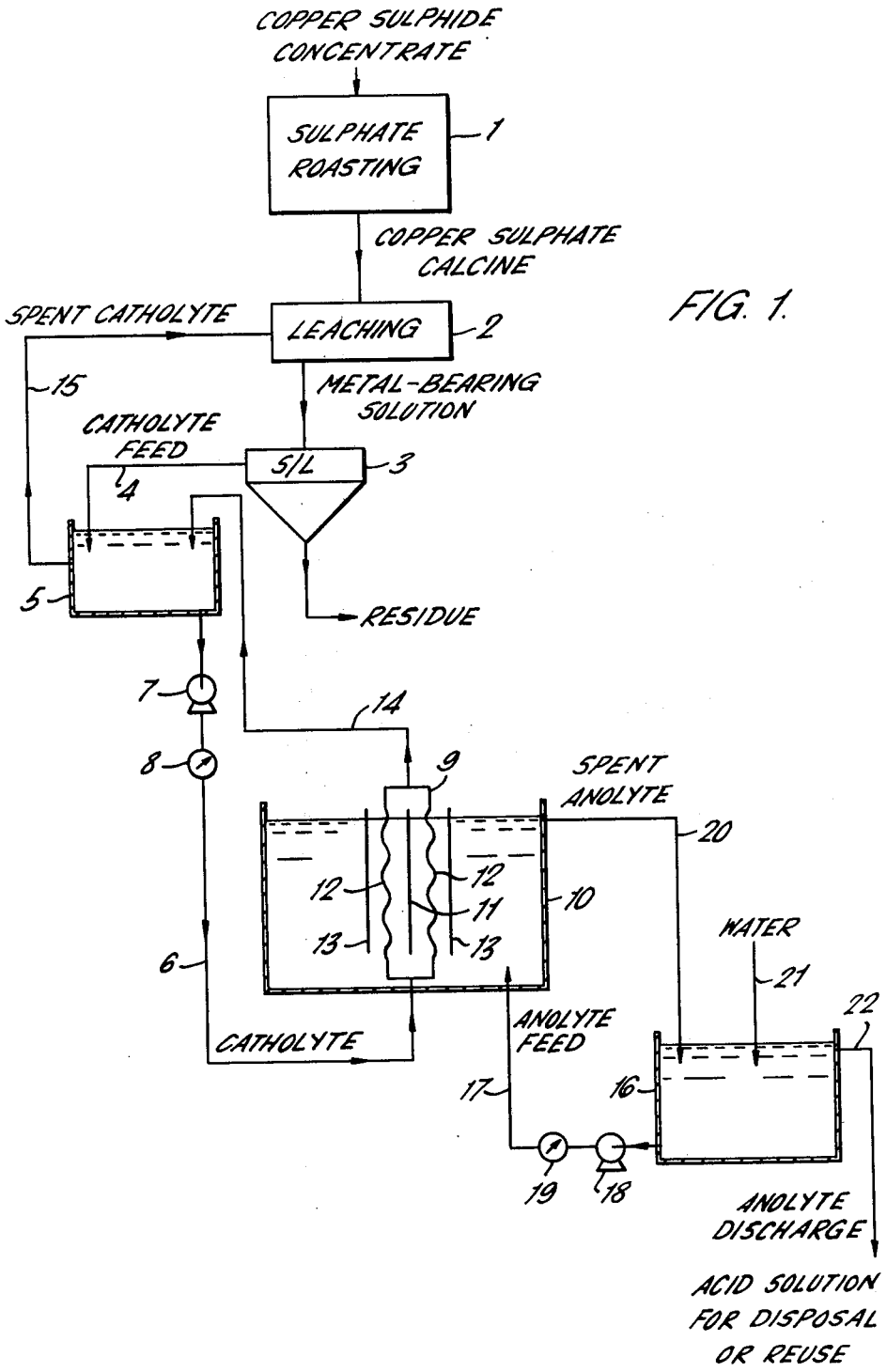

This invention relates to a hydrometallurgical process for the recovery of a metal or metals from a sulphurous feed material containing the metal or metals. The sulphurous feed material can be, for example, an ore, concentrate, matte, calcine, residue or precipitate containing free and/or combined sulphur.

According to the present invention there is provided a process for the recovery of a metal from a sulphurous feed material containing the metal, which process comprises leaching the sulphurous feed material with an aqueous leach solution to form an aqueous metal-bearing solution containing sulphate ions and ions of the metal; removing solids from the metal-bearing solution; and thereafter electrowinning the metal from the metal-bearing solution in an electrolytic cell having an anode compartment containing an anode and a cathode compartment containing a cathode, said compartments being separated by an ion-permeable, substantially fluid-impermeable membrane, by flowing the metal-bearing solution through the cathode compartment and flowing an aqueous acidic anolyte through the anode compartment, a potential difference being maintained between the anode and the cathode so as to electrodeposit ions of the metal from the metal-bearing solution onto the cathode and to cause the passage of sulphate ions through the membrane from the cathode compartment to the anode compartment.

The metal-bearing solution may be purified after it has been subjected to the solids-liquid separation step and before the metal is electrowon therefrom. The purification process may be for the removal from the solution of unwanted cations, elements or compounds and may comprise processes such as selective precipitation and resolution, cementation, solvent extraction or other known purification techniques. The purification process may be applied to all or a part of the metal-bearing solution. In the latter case, a portion of the metal-bearing solution may be bled from the bulk of the solution, purified and then returned to the bulk of the solution.

In a preferred embodiment of the process of the invention, the aqueous acidic anolyte is flowed around a circuit which includes the anode compartment of the electrolytic cell, and a proportion of the aqueous acidic anolyte is bled from the circuit whilst there is added to the circuit an aqueous fluid, usually water so that the composition of the aqueous acidic anolyte can be controlled. The amount of water added to the circuit in this way is normally such as to maintain substantially constant the volume and composition of the aqueous acidic anolyte in the circuit.

The process of the invention has been found to be particularly suitable for the recovery of copper and/or nickel from sulphurous feed materials containing such metals. It is also suitable for the recovery from sulphurous feed materials of those metals which are conventionally recovered by electrowinning, in particular cobalt and zinc.

When the invention is practised on a commercial scale, there would normally be employed a large number of electrowinning cells to win metal from the stream of metal-bearing solution. One way of arranging the cells would be to place a large number of anodes and cathodes in a tank in alternate relationship to each other with the ion-permeable, substantially fluid impermeable membranes enclosing the cathodes to form a cathode compartment around each cathode, and a single, common anode compartment formed by the walls of the tank. Alternatively, the anodes could be so enclosed by such membranes. Electrodes of like polarity in the tank would normally be connected in parallel to the electrical supply but generally in series from tank to tank. It is expected that the arrangement of fluid inlet and fluid outlet to the compartments of each of the cells would normally be such that they would be at opposed sides of each compartment; for example, if an electrolyte were fed into the bottom of an electrode compartment then it would flow out at the top of the compartment. When the amount of sulphate ions which must be removed from the metal-bearing solution in order to maintain its composition is less than that stoichiometrically corresponding to the amount of metal electrodeposited at the cathodes, only a proportion of the electrolytic cells need be equipped with an ion permeable, substantially fluid impermeable membrane in order that no more sulphate is removed than is introduced to the leach solution at the leaching stage.

In the process of the invention, the leaching step may comprise one or more leaching stages carried out under differing process conditions so as to provide one or more metal-bearing solutions containing different concentrations of one or more of the metals to be recovered. For example, a nickel/copper matte may conventionally be subjected to a pressure leaching process which usually has two or three stages. The first leaching stage provides a nickel-bearing solution containing a low concentration of copper from which nickel is electrowon. The second and any successive leaching stages provide nickel-bearing solutions containing high concentrations of copper, from which copper is electrowon.

In a preferred embodiment of the process of the invention, at least a part of the metal-bearing solution is returned to the leaching step after passage through the cathode compartment of the electrolytic cell.

Preferably, the ion-permeable, substantially fluid impermeable membrane which separates an anode and cathode compartment of any electrolytic cells in the process of the present invention is an anion exchange membrane. Such a membrane allows anions such as sulphate ions to migrate from the cathode compartment to the anode compartment of the cell but restricts or prevents passage of metal ions through the membrane. When such a membrane is used, the acidic anolyte which is bled from the circuit which includes the anode compartment of the electrolytic cell will have a sufficiently low concentration of metal ions, making it possible to dispose of this acidic anolyte without undue loss of metal. The acidic anolyte may be led off for use elsewhere if this is required, or if desired it may be disposed of by neutralisation with an alkaline material; a cheap material such as low quality calcium hydroxide or even mine tailings could be used for this purpose, and there would be no necessity to wash the resulting precipitate free from entrained metal values.

Advantageously, the or each cathode compartment comprises a substantially fluid-impermeable housing with an inlet and an outlet for the metal-bearing solution and with at least one wall of the housing constituted by an anion exchange membrane.

The concentration of the metal to be electrowon in the metal-bearing solution supplied to the cathode compartment of the electrolytic cell may vary within a broad range; it is expected that the solution will normally contain from 20 to 150 grams per liter of the metal and will often contain from 30 to 70 grams per liter of the metal, but the process of the invention is in no way limited to operation with solutions of such concentration. Similarly, the aqueous acidic anolyte used in the process of the invention will generally contain sulphuric acid and in an amount which may vary within a broad range; it is expected that the anolyte will normally contain from 5 to 150 grams per liter of sulphuric acid, and often from 10 to 50 grams per liter sulphuric acid, but the process of the invention is in no way limited to operation with anolytes of such concentration.

The process of the invention avoids the necessity for a neutralisation step in the main circuit including the electrowinning step. Such a neutralisation step has in the past given rise to problems of pipe scaling, introduction of impurities, loss of entrained metal valves and blocking of diaphragms used in the electrowinning stage. The problems of pipe scaling and disphragm blockage, which arise when, for example, calcium hydroxide is used for neutralisation, have in the past been avoided by use of sodium hydroxide for neutralisation. Sodium hydroxide is comparatively expensive and one advantage of the present invention is that any neutralisation which is necessary can be carried out after electrowinning, and can be effected with the relatively cheap materials such as calcium hydroxide or any other cheap and available alkaline material.

Figure 2:
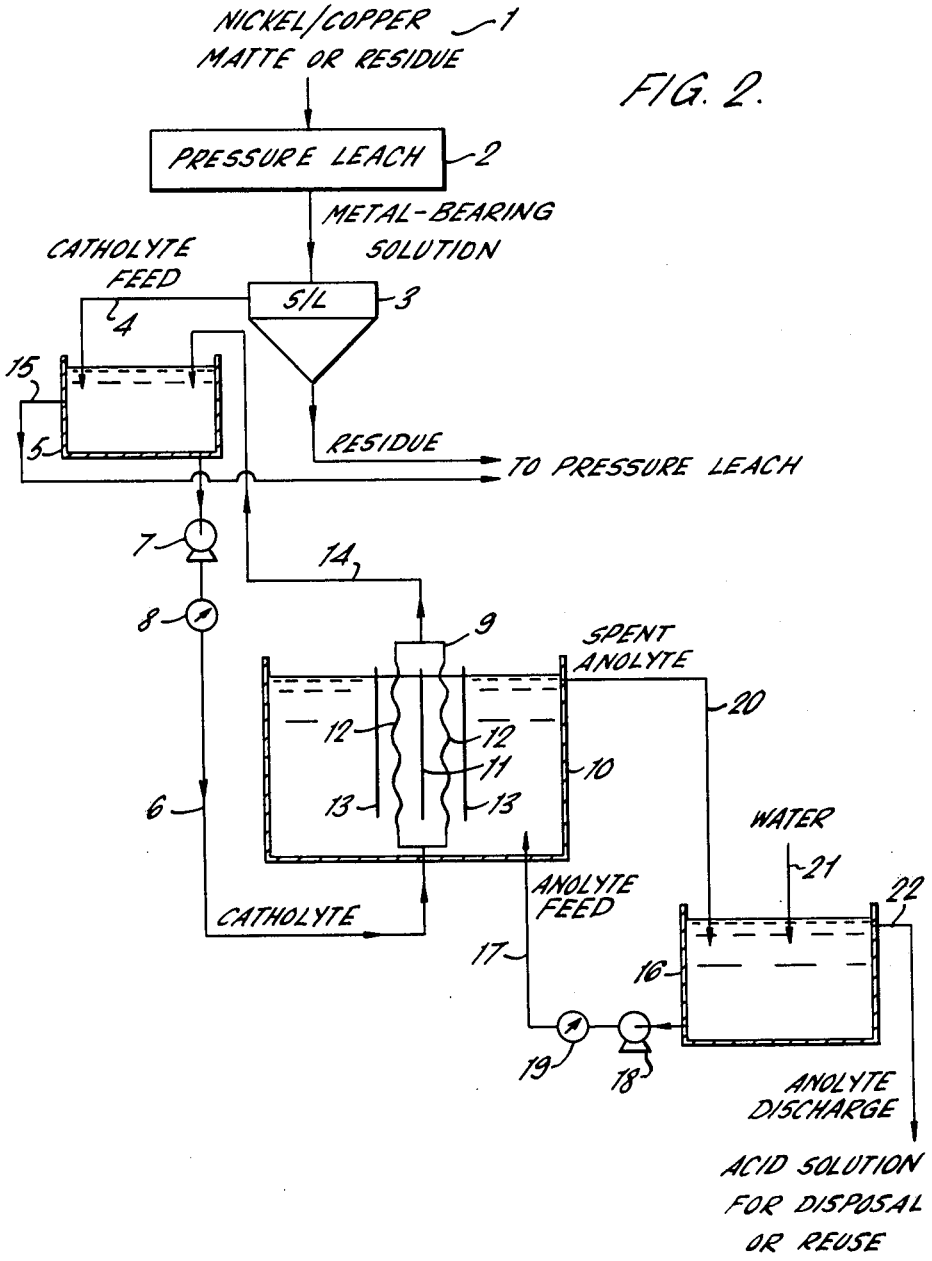

The invention will now be illustrated by the following Examples in which reference will be made to the accompanying drawings wherein:

FIG. 1 shows a schematic flowsheet of a hydrometallurgical process for the recovery of copper from a copper sulphide concentrate; and FIG. 2 shows a schematic flowsheet of a hydrometallurgical process for the recovery of nickel and copper from a nickel/copper matte.

EXAMPLE 1

Referring to FIG. 1, copper sulphide concentrate was sulphate roasted at 1 to provide a copper sulphate calcine. The copper sulphate calcine was leached at 2 with a low acid leach solution to provide a copper-bearing solution containing sulphate ions and ions of copper. Solids contained in the copper-bearing solution were removed by means of a known solids/liquid separation process (S/L) at 3. The copper-bearing solution 4 obtained from this separation process contained 39.4 grams per liter copper, and 29.5 grams per liter sulphuric acid. This solution constituted the catholyte feed which was supplied to a catholyte tank 5. Catholyte was supplied from the tank 5 through line 6 by means of a pump 7 and flow meter 8 to the lower end of the cathode compartment 9 of an electrowinning cell 10. The catholyte was maintained at a temperature of 52° C. The cathode compartment 9 consisted of a perspex housing two sides 12 of which were constituted by anion exchange membranes (each an Ionac MA-3475 membrane). A copper cathode 11 was located between the two anion exchange membranes 12. A planar lead-/antimony anode 13 was positioned adjacent each of the anion exchange membranes 12 so that there was a single anode compartment which surrounded the cathode compartment 9 and which itself was bounded by the walls of the cell 10. The anodes 13 were each separated from the cathode 11 by a distance of 8 cm. Catholyte passed from the top of the cathode compartment 9 via line 14 to the catholyte tank 5. Spent catholyte containing 26.3 grams per liter copper and 34.3 grams per liter sulphuric acid, was returned from the tank 5 via line 15 to the leaching stage 2. Anolyte for the electrowinning cell was provided from an anolyte tank 16 via line 17 by means of a pump 18 and a flow meter 19. The anolyte feed contained 22.4 grams per liter sulphuric acid, and was maintained at 52° C. Sufficient acidic anolyte solution was discharged from the tank 16 via line 22 and sufficient water was added to the anolyte tank 16 via line 21 to maintain both the volume and the acid concentration of the anolyte substantially constant. A potential difference of 2.26 volts was applied across the electrodes of the electrowinning cell which gave rise to electrodeposition of copper on the cathode 11. At a current of 33.1 amps and a current density of 200.7 amps per sq. meter, 930 grams of copper were deposited on the cathode 11 during a running time of 24 hours at a current efficiency of 98.9% and with a power consumption of 1.93 kWh/kg copper deposited. The use of the anion exchange membrane 12 resulted in an acid diffusion rate of 0.22 grams sulphuric acid, per gram of copper plated, across the membranes from anolyte to catholyte, which corresponds to a diffusion across the membrane of 86% of the sulphate produced as a result of the cathodic reaction.

EXAMPLE 2

A hydrometallurgical process for the electrowinning of nickel was carried out using a circuit as shown in FIG. 2. This is identical to that shown in FIG. 1 except in the initial stages for obtaining a metalliferous solution and in the way in which the spent catholyte and the residue from the solids/liquid separation process are employed. A nickel/copper matte 1 was pressure leached at 2 with an acid leach solution to leach nickel from the matte. The resulting nickel-bearing solution was subjected to a conventional solids/liquid separation process (S/L) at 3 to give a solid-containing residue and a liquid which constituted the catholyte feed 4. An additional purification stage may be included between the solids/liquid separation stage 3 and the catholyte tank 5. In the present example, the supply of catholyte and anolyte to the electrowinning cell 10, and the nature and operation of this cell itself, were the same as described in the preceding example with reference to FIG. 1. The catholyte feed 4 contained 67.2 grams per liter nickel at a pH of 5.2, and was added to the catholyte tank 5 at a rate of 1.5 liters per hour. The spent catholyte issuing from line 15 contained 43.5 grams per liter nickel and was at a pH of 3.4. The anolyte contained 12.0 grams per liter sulphuric acid. The catholyte was supplied to the cathode compartment 9 at a rate of 0.5 liters per minute, and anolyte was circulated by pump 18 at a rate of 1.0 liter per minute. The anolyte and catholyte were maintained at 55° C., and the potential difference applied between the electrodes was 3.38 volts. During a running time of 30 hours, 1051 grams of nickel were plated on to the cathode 11. The current was 34.5 amps at a current density of 209 amps per square meter, the current efficiency being 92.7% and the power consumption 3.33 kilowatt hours per kilogram of nickel deposited. The use of the anion exchange membranes 12 permitted sulphate to diffuse across the membrane from anolyte to catholyte at a rate of 0.18 grams of sulphate per gram of nickel deposited, which corresponds to a diffusion across the membrane of 90% of the sulphate produced as a result of the cathodic reaction.

What is claimed is:

1. A process for the recovery of a metal from a sulphurous feed material containing the metal, which process comprises leaching the sulphurous feed material with an aqueous leach solution to form an aqueous metal-bearing solution containing sulphate ions and ions of the metal; removing solids from the metal-bearing solution; and thereafter electrowinning the metal from the metal-bearing solution in an electrolytic cell having an anode compartment containing an anode and a cathode compartment containing a cathode, said compartments being separated by an ion-permeable, substantially fluid-impermeable membrane, by flowing the metal-bearing solution through the cathode compartment and flowing an aqueous acidic anolyte through the anode compartment, a potential difference being maintained between the anode and the cathode so as to electrodeposit ions of the metal from the metal-bearing solution onto the cathode and to cause the passage of sulphate ions through the membrane from the cathode compartment to the anode compartment.

2. A process according to claim 1, wherein the sulphurous feed material containing the metal contains at least one metal selected from the group consisting of nickel, copper, cobalt and zinc.

3. A process according to claim 2, wherein the metal-bearing solution which is flowed through the cathode compartment(s) of the electrowinning cell contains from 20 to 150 grams per liter of the metal which is to be electrowon.

4. A process according to claim 3, wherein the metal-bearing solution which is flowed through the cathode compartment(s) of the electrowinning cell contains from 30 to 70 grams per liter of the metal which is to be electrowon.

5. A process according to claim 3, wherein the aqueous acidic anolyte contains from 5 to 150 grams per liter of sulphuric acid.

6. A process according to claim 5, wherein the aqueous acidic anolyte contains from 10 to 50 grams per liter of sulphuric acid.

7. A process according to claim 1, wherein the aqueous acidic anolyte is flowed around a circuit which includes the anode compartment of the electrolytic cell, and a proportion of the aqueous acidic anolyte is bled from the circuit while there is added to the circuit an aqueous fluid so that the composition of the aqueous acidic anolyte can be controlled.

8. A process according to claim 7, wherein the said aqueous fluid is water.

9. A process according to claim 1, wherein the metal bearing solution is purified after solids have been removed therefrom and before the metal is electrowon therefrom.

10. A process according to claim 1, wherein the metal-bearing solution is flowed through a plurality of cathode compartments of the electrowinning cell and wherein the aqueous acidic anolyte is flowed through a single, common anode compartment disposed about the cathode compartments.

11. A process according to claim 1, wherein at least a part of the metal-bearing solution is recycled to the leaching step after it has passed through the cathode compartment of the electrolytic cell.

12. A process according to claim 1, wherein the ion-permeable, substantially fluid-impermeable membrane is an anion exchange membrane.

13. A process according to claim 1, wherein the cathode compartment comprises a substantially fluid-impermeable housing with an inlet and an outlet for the metal-bearing solution and with at least one wall of the housing constituted by an anion exchange membrane.

14. A process for the recovery of a metal from a sulphurous feed material containing the metal, which process comprises leaching the sulphurous feed material with an aqueous acidic leach solution to form an aqueous metal-bearing solution containing sulphate ions and ions of the metal; removing solids from the metal-bearing solution; and thereafter electrowinning the metal from the metal-bearing solution in an electrolytic cell having a cathode compartment containing a cathode and an anode compartment containing an anode and disposed about the cathode compartment, said compartments being separated by a substantially fluid-impermeable anion exchange membrane, by flowing the metal-bearing solution through the cathode compartment and flowing an aqueous acidic anolyte around a circuit which includes the anode compartment of the electrolytic cell and in which a proportion of the aqueous acidic anolyte is bled from the circuit while water is added to the circuit so that the composition of the aqueous acidic anolyte can be controlled, a potential difference being maintained between the anode and the cathode so as to electrodeposit ions of the metal from the metal-bearing solution onto the cathode and to cause the passage of sulphate ions through the membrane from the cathode compartment to the anode compartment, wherein a part of the metal-bearing solution is recycled to the leaching step after it has passed through the cathode compartment of the electrolytic cell.

15. A process according to claim 14, wherein the metal-bearing solution is flowed through a plurality of cathode compartments of the electrowinning cell and wherein the aqueous acidic anolyte is flowed through a single, common anode compartment disposed about the cathode compartments.

16. A process according to claim 14, wherein the cathode compartment comprises a substantially fluid-impermeable housing with an inlet and an outlet for the metal-bearing solution and with at least one wall of the housing constituted by an anion exchange membrane.

17. A process according to claim 14, wherein the metal is selected from the group consisting of copper and nickel.

* * * * *